US009142375B2

(12) United States Patent
Besana et al.

(10) Patent No.: US 9,142,375 B2
(45) Date of Patent: Sep. 22, 2015

(54) SOLID STATE SWITCHING DEVICE

(71) Applicant: ABB S.p.A., Milan (IT)

(72) Inventors: Stefano Besana, Terno d'Isola (IT); Flavio Pasquale, Bergamo (IT)

(73) Assignee: ABB S.P.A, Milano (IT)

( * ) Notice: Subject to any disclaimer, the term of this patent is extended or adjusted under 35 U.S.C. 154(b) by 241 days.

(21) Appl. No.: 13/948,430

(22) Filed: Jul. 23, 2013

(65) Prior Publication Data

US 2014/0029153 A1 Jan. 30, 2014

(30) Foreign Application Priority Data

Jul. 24, 2012 (EP) ..... 12177668

(51) Int. Cl.

| | |
|---|---|
| ***H01H 73/00*** | (2006.01) |
| ***H01H 89/00*** | (2006.01) |
| ***H01H 71/02*** | (2006.01) |
| ***H01H 71/12*** | (2006.01) |
| ***H01Q 9/06*** | (2006.01) |

(52) U.S. Cl.

CPC ..... *H01H 89/00* (2013.01); *H01H 71/0207* (2013.01); *H01H 71/123* (2013.01); *H01Q 9/06* (2013.01)

(58) Field of Classification Search

CPC ..... H01H 9/30; H01H 33/143; H01H 89/00
USPC ..... 361/115
See application file for complete search history.

(56) References Cited

U.S. PATENT DOCUMENTS

| | | | | |
|---|---|---|---|---|
| 4,181,906 | A * | 1/1980 | Matsko et al. | 335/6 |
| 7,612,972 | B2 * | 11/2009 | Battani et al. | 361/42 |
| 8,137,120 | B2 * | 3/2012 | Bortoli et al. | 439/115 |
| 8,284,528 | B2 * | 10/2012 | Koshin et al. | 361/2 |
| 2012/0081829 | A1 * | 4/2012 | Scharnick | 361/160 |
| 2012/0320487 | A1 * | 12/2012 | Cortinovis et al. | 361/115 |
| 2014/0029153 | A1 * | 1/2014 | Besana et al. | 361/115 |

FOREIGN PATENT DOCUMENTS

| | | | |
|---|---|---|---|
| EP | 2256884 | A1 | 12/2010 |
| WO | WO-2010026013 | A1 | 3/2010 |

OTHER PUBLICATIONS

Extended European Search Report, European Application No. 12177668.6.

* cited by examiner

*Primary Examiner* — Thienvu Tran
*Assistant Examiner* — Christopher Clark
(74) *Attorney, Agent, or Firm* — Novak Druce Connolly Bove + Quigg LLP

(57) ABSTRACT

Switching device comprising:

a switching unit comprising, for each electric pole, a first disconnection contact, a second disconnection contact and one or more solid state switches;

a supporting frame comprising, for each electric pole, a third disconnection contact and a fourth disconnection contact, which are coupled/separated respectively with/from the first and second disconnection contacts, when the switching unit is in an insertion/withdrawn position with respect to the supporting frame;

actuating means for moving the switching unit between the insertion position and said the withdrawn position, and viceversa;

a control unit comprising control means that are configured to coordinate the operation of the actuating means and the solid state switches, when an insertion/withdrawn operation of the switching unit has to be performed, so that the actuating means move the switching unit only when the solid state switches are in an off-state.

20 Claims, 20 Drawing Sheets

SOLID STATE SWITCHING DEVICE

TECHNICAL FIELD

The present invention relates to the technical field of the low voltage switching devices, such as circuit breakers, disconnectors, contactors and the like.

More particularly, the present invention is related to a switching device having a switching unit that comprises one or more solid state switches.

For the purposes of the present invention, the term "low voltage" relates to voltages lower than 1 kV AC and 1.5 kV DC.

BACKGROUND ART

As known, low voltage switching devices are used in electric circuits or grids to allow the correct operation of specific parts of these latter.

For instance, low voltage switching devices ensure the availability of the nominal current necessary for several utilities, enable the proper insertion and disconnection of electric loads, protect (especially circuit breakers) the electric grid and the electric loads installed therein against fault events such as overloads and short circuits.

Numerous industrial solutions for the aforementioned switching devices are available on the market.

Conventional electro-mechanical switching devices generally have an external case that houses one or more electric poles.

Each pole comprises a couple of separable contacts to break and conduct current.

A driving mechanism causes the movable contacts to move between a first closed position, in which they are coupled to the corresponding fixed contacts, and a second open position, in which they are spaced away from the corresponding fixed contacts.

In closed position, well designed contacts result in quite low power losses, whereas in open position they provide a galvanic (electrical) isolation between the portions of the electric poles that are electrically upstream and downstream connected, provided that their mutual physical separation is above a minimum value.

Such a galvanic isolation is very important in common practice, since it enables safe repairing and maintenance works on the circuit in which the switching device is inserted.

Although such conventional switching devices have proven to be very robust and reliable, in direct current ("DC") applications, and mainly at relatively high voltages (up to 1500V), the interruption time can be quite long, and therefore electric arcs, which usually strike between mechanical contacts under separation, may consequently last for a relatively long time.

Severe wear of the contact may thus arise, with a consequent remarkable reduction of the electrical endurance, i.e. the number of switching operations that a switching device can perform.

In order to face with such issues, so-called Solid-State Circuit Breakers ("SSCBs") have been designed, which adopt, for each electric pole, one or more solid state switches for current breaking purposes.

Typically, solid state switches are semiconductor-based switching devices that can commutate between an on-state and an off-state.

The main advantage of SSCBs resides in that they have potentially unlimited electrical endurance due to their arcless breaking operations.

Further, their interruption time is remarkably shorter in comparison with the interruption time of the electro-mechanical switching devices.

On the other hand, SSCBs generally require intensive cooling to remove the heat generated by the current flowing through the solid state switches, when these latter are in an on-state.

An even more relevant drawback resides in that SSCBs are not suitable for providing a galvanic isolation between upstream and downstream connected portions of the electric poles.

In fact, small currents (leakage currents) flow through the solid state switches, even if these latter are in an off-state.

In order to mitigate these problems, there have been developed hybrid solutions, in which, for each electric pole, conventional electro-mechanical switches are electrically connected in parallel and/or in series with the solid state switches of the pole.

Hybrid SSCBs have proven to be quite reliable and effective in their operation but they are affected by some drawbacks, too.

Generally, they are relatively bulky and difficult to install on the field. Further, they have a relatively complex constructive layout that is often expensive to realize at industrial level.

In addition, the operations of the solid state and electro-mechanical switches must be managed according to very precise time sequences and a tight timing.

Therefore, in the market it is still felt the demand for technical solutions capable of solving, at least partially, the drawbacks mentioned above.

SUMMARY OF INVENTION

In order to respond to this need, the present invention provides a switching device, according to the following claim 1 and the related dependent claims.

BRIEF DESCRIPTION OF THE DRAWINGS

Further characteristics and advantages of the present invention shall emerge more clearly from the description of preferred but not exclusive embodiments illustrated purely by way of examples and without limitation in the attached drawings, in which.

BEST AND VARIOUS MODES FOR CARRYING OUT INVENTION

Figure 1:
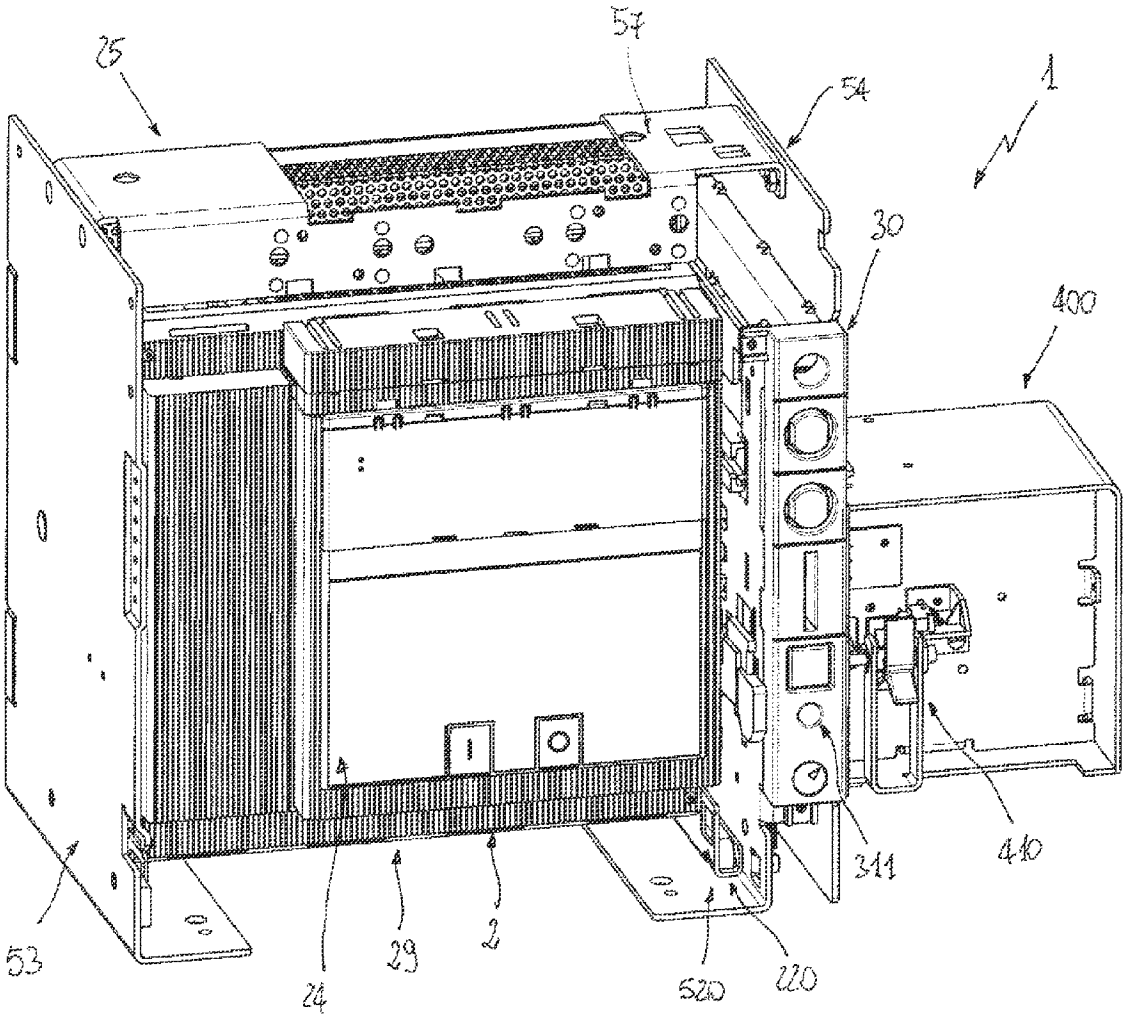
FIGS. 1, 1A, 2-6, 6A schematically show different views of an embodiment of a switching device, according to the invention.
Figure 1A:
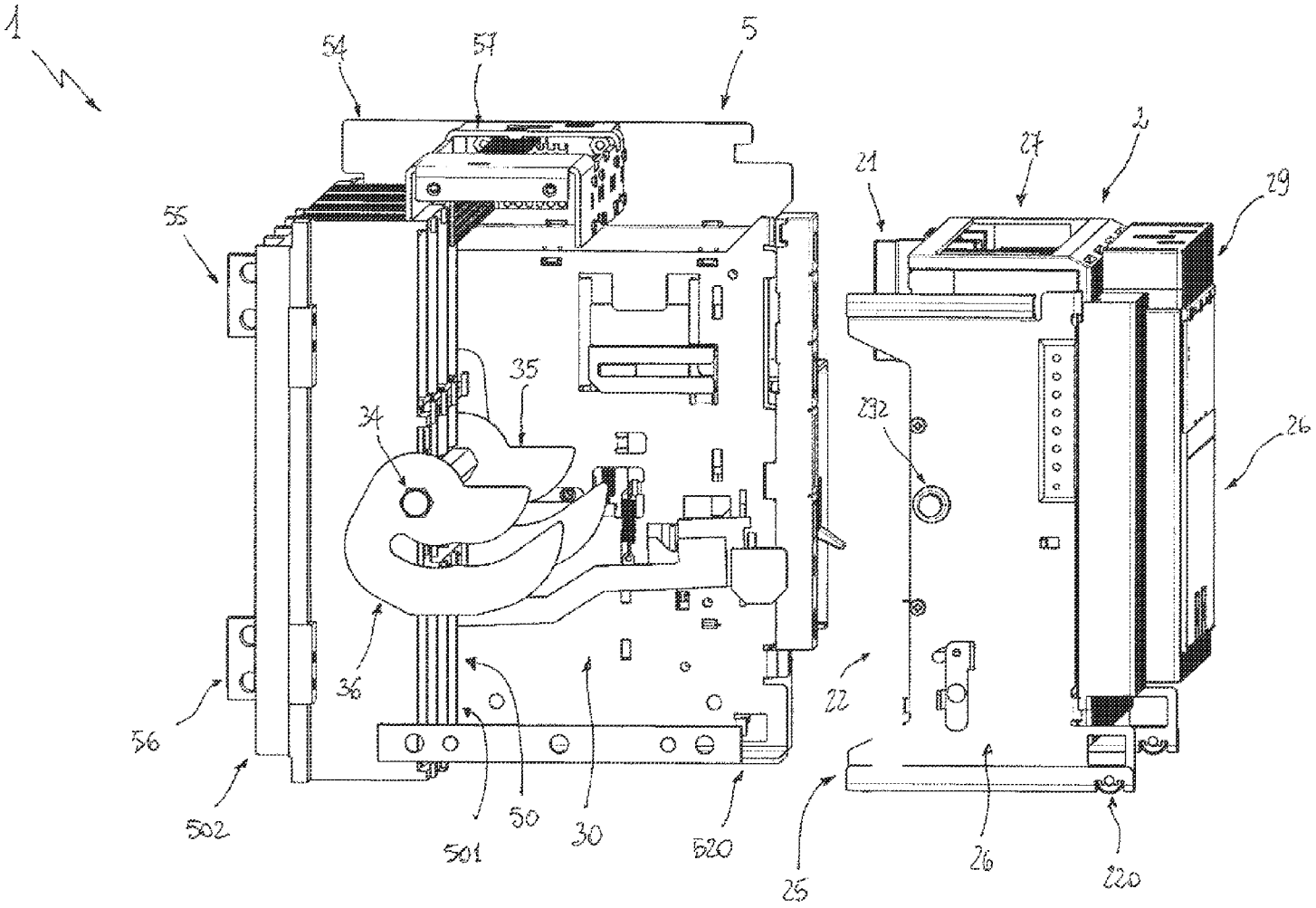

With reference to the mentioned figures, in a first aspect, the present invention relates to a switching device 1 for LV circuits, such as a LV circuit breaker, disconnector, contactor and the like.

The switching device 1 includes a switching unit 2 that comprises an external case 29 that houses one or more electric poles 2A, 2B.

The number of electric poles of the switching unit 2 may vary, according to the needs. For example, in the embodiment shown in FIGS. 1, 1A, 2-6, 6A the switching unit 2 comprises a single electric pole 2A, while in the embodiment shown in FIGS. 7-10, the switching unit 2 comprises two electric poles 2A, 2B.

For each electric pole, the switching unit 2 comprises a first disconnection contact 21 and a second disconnection contact 22, which are arranged on an outer wall.

In particular, the switching unit 2 comprises front and back walls 24, 25 which are opposite to each other, lateral walls 26, 27, which are opposite to each other and substantially perpendicular to the walls 24, 25, and upper and lower walls 26A, 27A, which are opposite to each other and substantially perpendicular to the walls 24, 25, 26, 27.

In a normal operative positioning of the switching device 1, the walls 24, 25, 26, 27 are vertically oriented with respect to the ground while the upper and lower walls 26A, 27A are horizontally oriented.

The disconnection contacts 21, 22 are preferably arranged on the back wall 25.

Preferably, the disconnection contacts 21, 22 are of the socket/plug type. As shown in the cited figures, they may be plug contacts that protrude from the back wall 25 of the switching unit 2.

For each electric pole, the switching unit 2 comprises one or more solid state switches 20, which are advantageously semiconductor-based switching devices, such as, for example, Power MOSFETs, Insulated Gate Bipolar Transistors ("IGBTs"), Gate Turn-Off Thyristors. (GTOs), Integrated Gate-Commutated Thyristors ("IGCTs") or the like.

As shown in the cited figures, for each electric pole, the switching unit 2 may comprise a plurality of solid state switches 20 that may be electrically connected in series or in parallel, according to the needs.

In other embodiments of the present invention, the switching unit 2 may comprise a single solid state switching device 20 for each electric pole.

Preferably, for each electric pole, the switching unit 2 comprises a venting group 280 that includes suitably arranged venting means 28 operatively associated to the solid state switches 20 in order to ensure a suitable removal of the heat generated during the operation of these latter.

The solid state switches 20 of each electric pole are electrically connected in series with the first and second disconnection contacts 21, 22 and are positioned between these latter, so that they can break/conduct the phase current through the electric pole of the switching unit 2.

The solid state switches 20 can be switched between an on-state, in which they allow the phase current to flow through the related electric pole, and an off-state, in which they break the phase current, and viceversa.

The switching device 1 comprises a supporting frame 5 that comprises, for each electric pole of the switching unit 2, a third disconnection contact 51 and a fourth disconnection contact 52, which are arranged on a supporting wall 50 of the supporting frame 5.

The electrical contacts 51, 52 are arranged for being coupled/separated with/from the corresponding electric contacts 21, 22.

Preferably, they are of the socket/plug type. As shown in the cited figures, they may be socket contacts that are arranged on suitable seats obtained on the supporting wall 50, at a side 501 of this latter.

The supporting frame 5 preferably has two side walls 53, 54, at which it is solidly connected with a fixed support (not shown), and a transversal supporting wall 50 that is positioned between the lateral walls 53, 54 and is substantially perpendicular with respect to these latter. A further transversal reinforcing wall 57 may be perpendicularly arranged between the lateral walls 53, 54.

In a normal operative positioning of the switching device 1, the walls 50, 53, 54 are oriented vertically with respect to the ground while the reinforcing wall 57 is horizontally oriented. Preferably, the supporting wall 50 has a front side 501, which faces an outer wall of the switching unit 2, in particular the back wall 25, and an opposite rear side 502.

The disconnection contacts 51, 52 are arranged at the front side 501.

At the rear side 502 of the supporting wall 50, the supporting frame 5 comprises a first bus contact 55 and a second bus contact 56 for each electric pole of the switching unit 2.

The bus contacts 55, 56 are arranged for electrical connection with external devices or power buses. In particular, the bus contacts 55, 56 are electrically connected with the external devices or power buses when the switching device 1 is installed on the field.

Properly arranged conductors (not shown) electrically connect the bus contacts 55, 56 with the disconnection contacts 51, 52, respectively.

Figure 16:
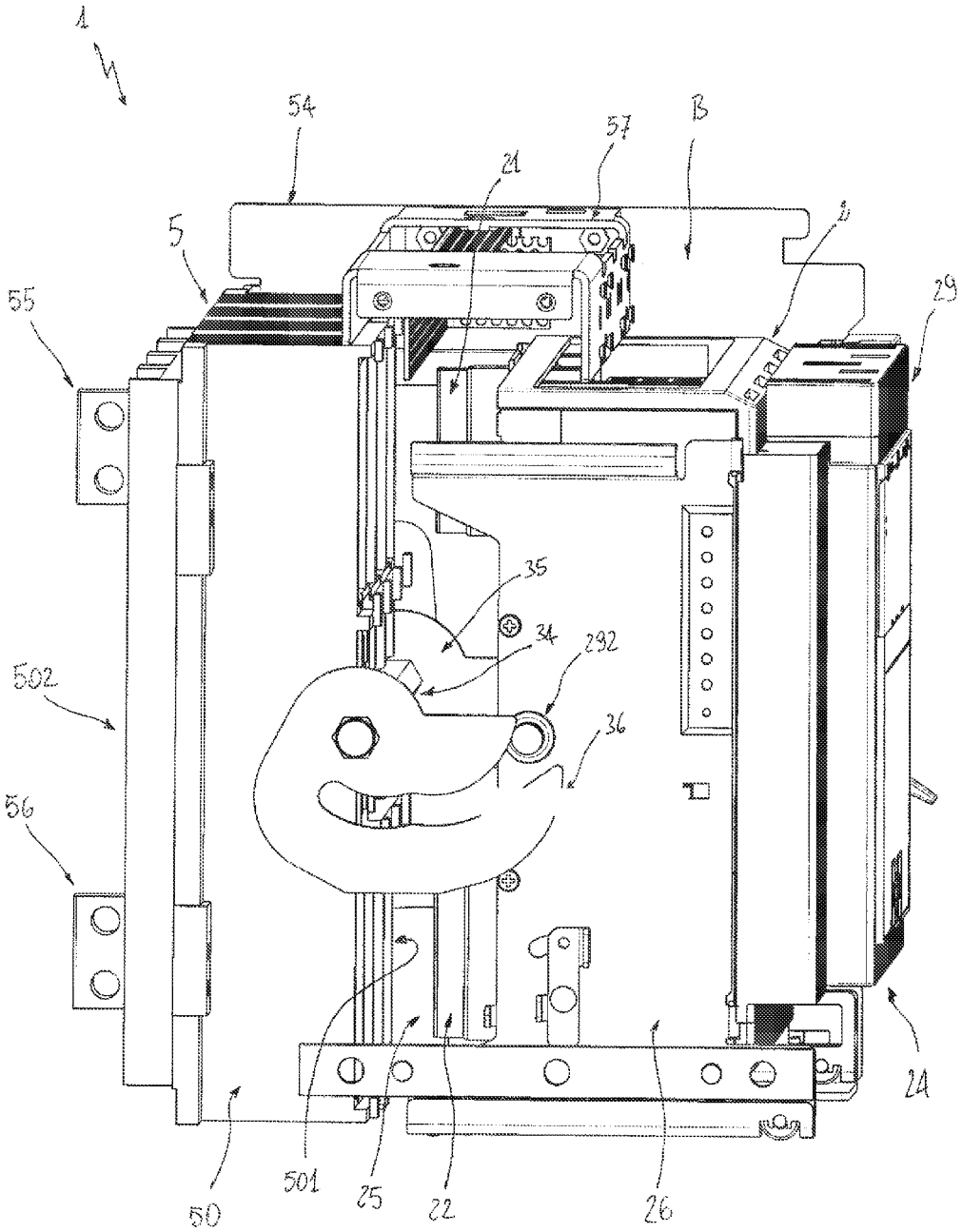
FIGS. 16-17 schematically show the switching device of FIG. 1 in different operative positions.
Figure 17:
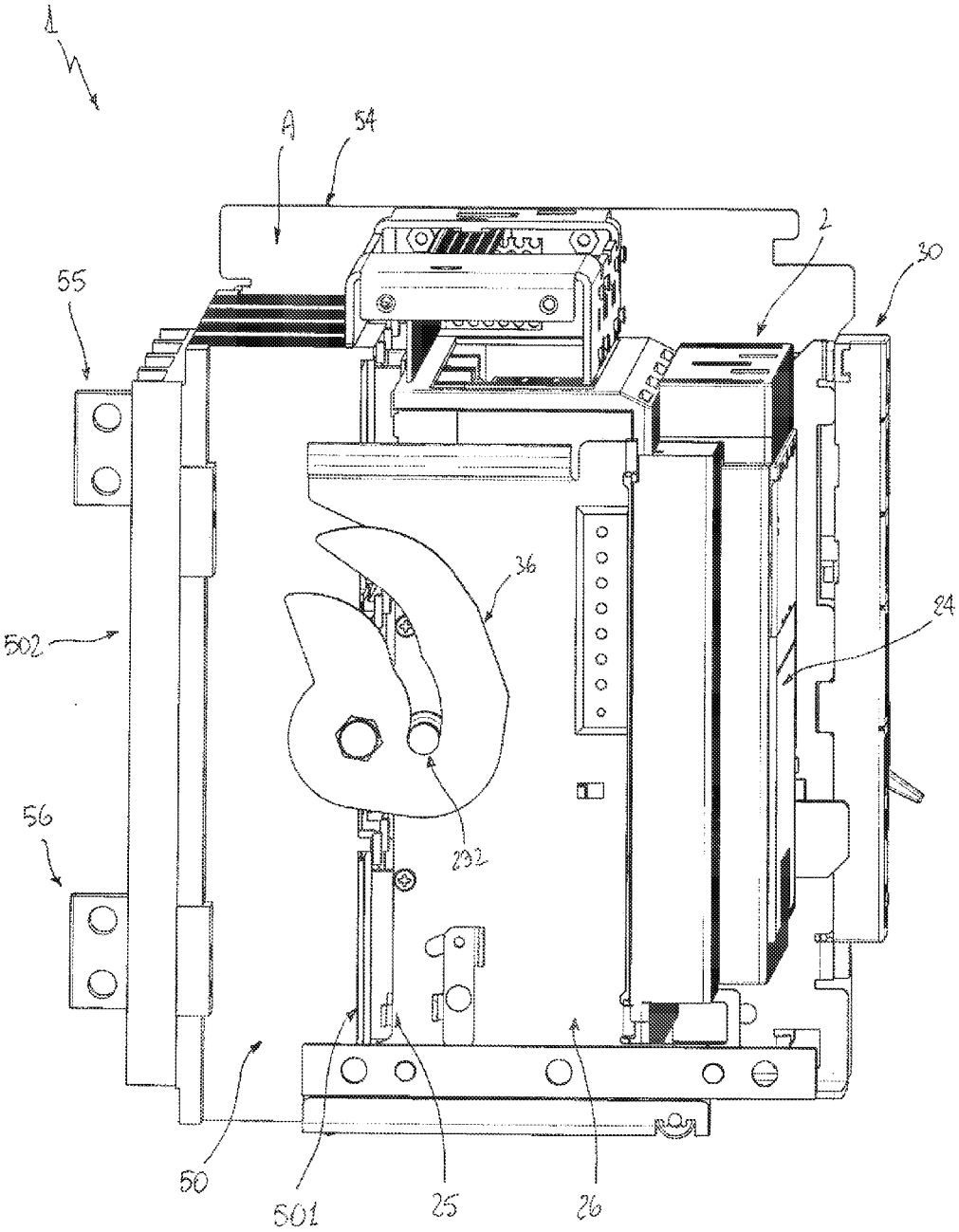
Figure 18:
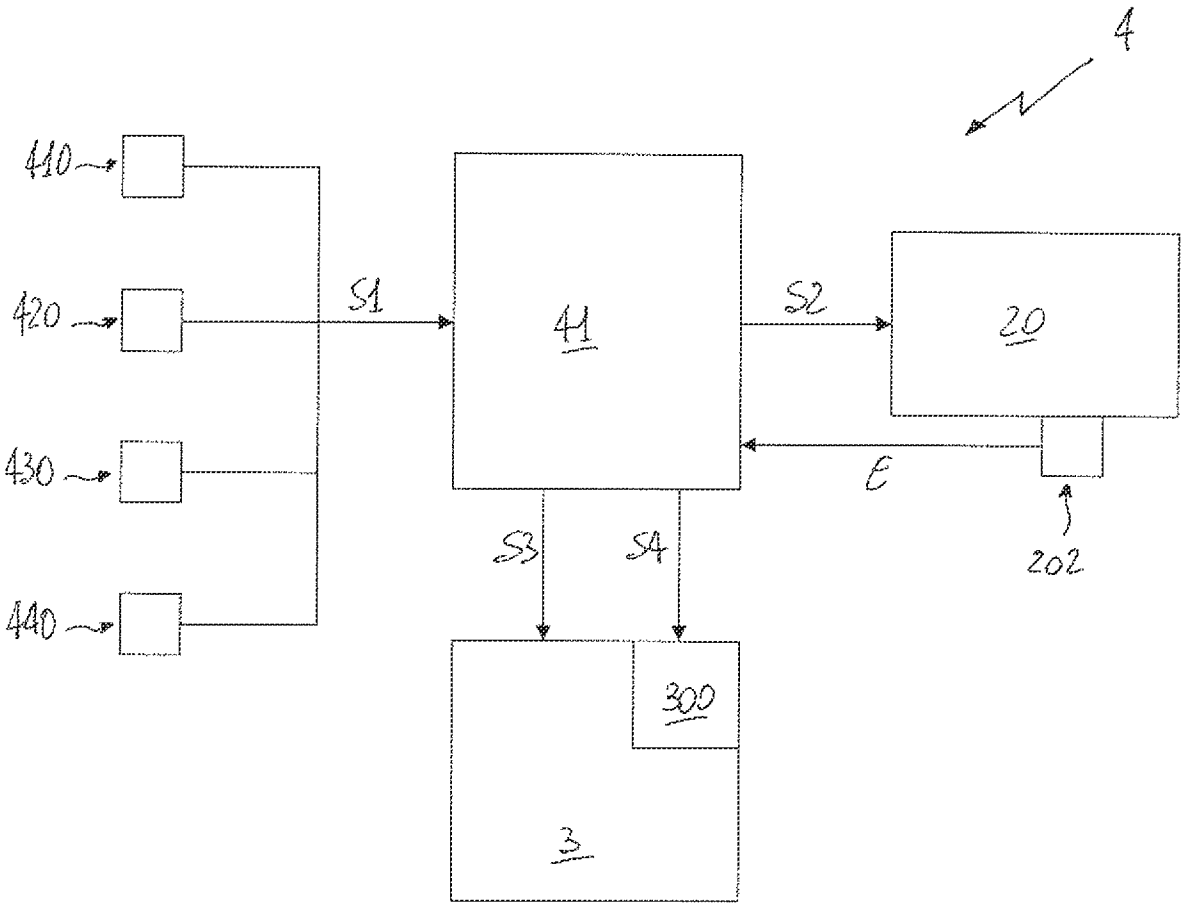
FIG. 18 schematically shows a possible embodiment of a control unit of the switching device, according to the invention.

The switching unit 2 is movable with respect to supporting frame 5, namely between an insertion position A (FIG. 17) and a withdrawn position B (FIG. 16), and viceversa.

During the transition between the insertion position A and the withdrawn position B, or viceversa, the switching unit 2 performs a translatory movement that occurs along a direction substantially perpendicular to the supporting wall 50.

Preferably, the lateral walls 26, 27 of the switching unit 2 are slidingly coupled with the lateral walls 53, 54 of the supporting frame 5, respectively.

To this aim, coupling means including rollers 220 and guiding edges 520 or the like may be suitably arranged, as shown in the cited figures.

Depending on the relative positioning of the switching unit 2, the supporting wall 50 of the supporting frame 5 is operatively associated/separated, at its front side 501, with/from an outer wall of the external case 29 of the switching unit 2, in particular with the back wall 25.

The disconnection contacts 51, 52 are coupled with the respective disconnection contacts 21, 22, when the switching unit 2 is in the insertion position A. On the other hand, the disconnection contacts 51, 52 are separated from the disconnection contacts 21, 22, respectively, when the switching unit 2 is in the withdrawn position B.

The switching device 2 comprises actuating means 3 for moving the switching unit 2 between the mentioned insertion position A and withdrawn position B, and viceversa.

In order to provide the mechanical energy for moving the switching unit 2, the actuating means 3 may comprise motor means 300.

The switching unit 2 may be also manually operated directly by an actuation tool (not shown), e.g. a crank, to be inserted in a suitable manoeuvring seat 311 that can be accessed for example by a user at the front wall 24 of the switching unit 2.

Preferably, the actuating means 3 comprise mechanical transmission means 30 that are configured to transmit the mechanical energy for moving the switching unit 2, which is received from the motor means 300 or by the manually operated actuation tool.

Preferably, the motor means 300 comprise an electric motor 301, which may be fed by an auxiliary power supply (not shown).

The electric motor 301 has a motor shaft 304 that is operatively connected to a motor transmission mechanism 302 that transmits the rotary movement of the motor shaft 304 to the mechanical transmission means 30.

The motor transmission mechanism 302 may advantageously comprise, as shown in FIGS. 11-14, a plurality of toothed wheels or other gears that are suitably arranged to transmit the rotary movement of the motor shaft 304 with a certain transmission ratio.

According to a preferred embodiment, the mechanical transmission means 30 comprise a first kinematic chain 31, which is configured to transform the motion imparted by the motor means 300, in particular by the transmission mechanism 302, or by the manually operated actuation tool, in a translatory motion of a movable carriage 32.

The mechanical transmission means 30 comprise also a second kinematic chain 33, which is configured to transform the translatory motion of the movable carriage 32 in a rotary motion of a transmission shaft 34.

The transmission shaft 34 is operatively connected to the side walls 53, 54 of the supporting frame 5 and it can freely rotate with respect to them.

The transmission shaft 34 is solidly connected with a first clamping element 35 and second clamping element 36 that can be operatively coupled respectively to a first clamping pin 291 and a second clamping pin 292 of the external case 29 of the switching unit 2.

The clamping pins 291, 292 are advantageously positioned on the lateral walls 26, 27 of the switching unit 2 and are arranged so as to protrude from them.

Preferably, the clamping elements 35, 36 are formed by a first plate 351 and a second plate 361, which are shaped so as to define a first clamping seat 352 and a second clamping seat 362 that can operatively couple with the clamping pins 291, 292, respectively.

The clamping seats 352, 362 have first clamping edges 353 and second clamping edges 363, at which they are coupled with said first and second clamping pins, respectively.

Advantageously, the clamping edges 353, 363 are shaped so as to have an eccentric profile with respect to the rotation axis of the transmission shaft 34.

In this manner, when they are coupled with the clamping pins 291, 292, the clamping edges 353, 363 are capable of imparting a translatory movement to the switching device 2, during the rotation of the transmission shaft 4.

Obviously, the direction of said translatory movement is determined by the direction of rotation of the transmission shaft 4.

Preferably, the clamping edges 353, 363 have respectively first portions 353A, 363A and second portions 353B, 363B, which are shaped so as to have different eccentric profiles with respect to the rotation axis of the transmission shaft 34.

In this manner, the coupling edges 353, 363 are capable of imparting a translatory movement to the switching device 2, which has different speeds for a given rotational speed of the transmission shaft 34, depending on the achieved coupling position between the switching unit 2 and the supporting frame 5.

In possible embodiments of the present invention (not shown), the mechanical energy for moving the switching unit 2 may be provided by one or more actuating springs that are operatively associated to the switching unit 2 and the supporting frame 5.

In particular, said actuation springs move the switching unit 2 only during a withdrawn operation of this latter.

During an insertion operation of the switching unit 2, which may be executed manually or by activating the motor means 300, said actuating springs are compressed and kept in such a compression state by a first blocking mechanism (not shown).

When a withdrawn operation of the switching unit 2 has to be performed, said first blocking mechanism is disabled and the actuating springs can push the switching unit 2 away from the insertion position A, towards the withdrawn position B.

According to the invention, the switching device 1 comprises a control unit 4, which is configured to control the operation of switching unit 2 and the actuating means 3.

Figure 2:
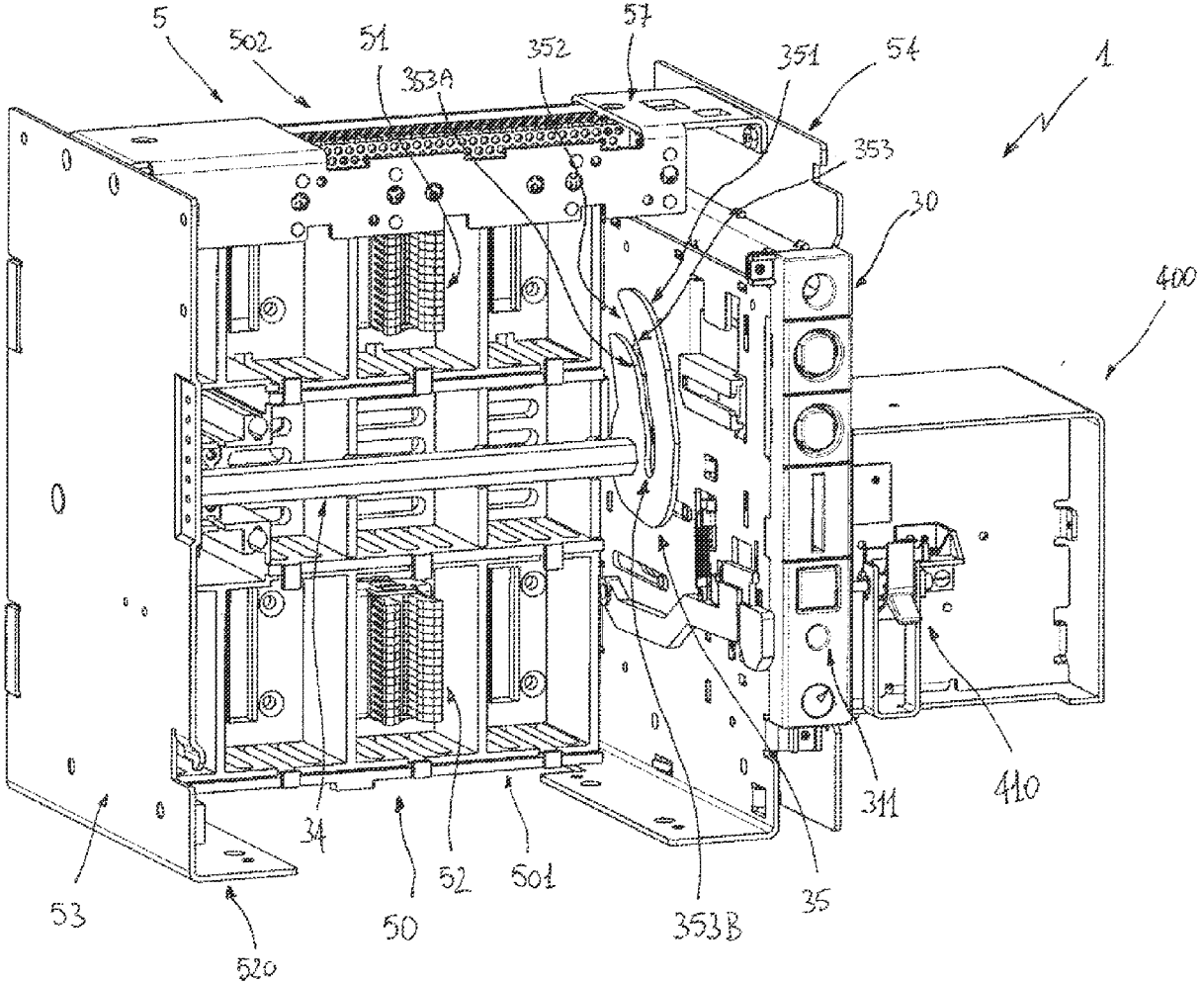
Figure 3:
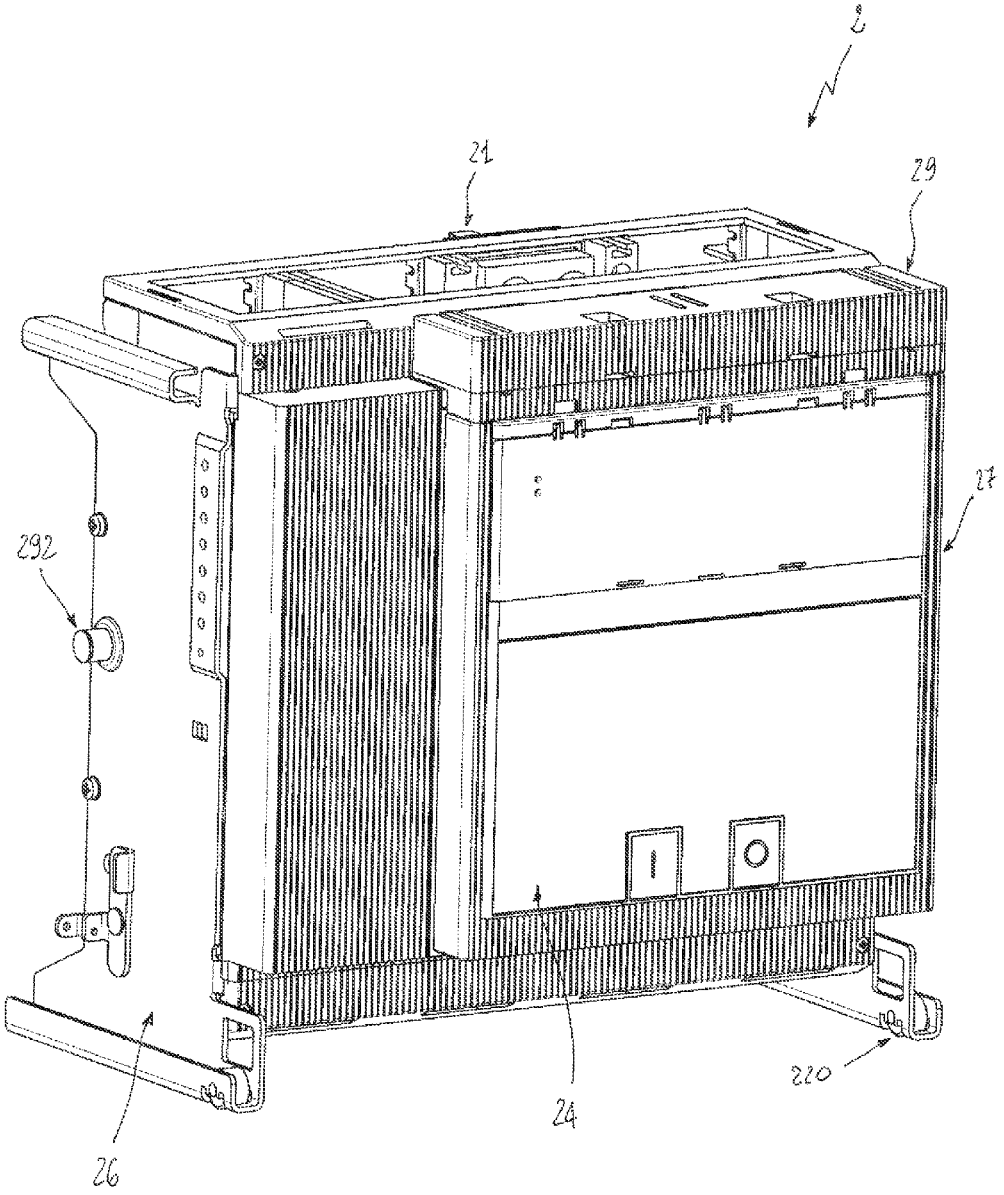
Figure 4:
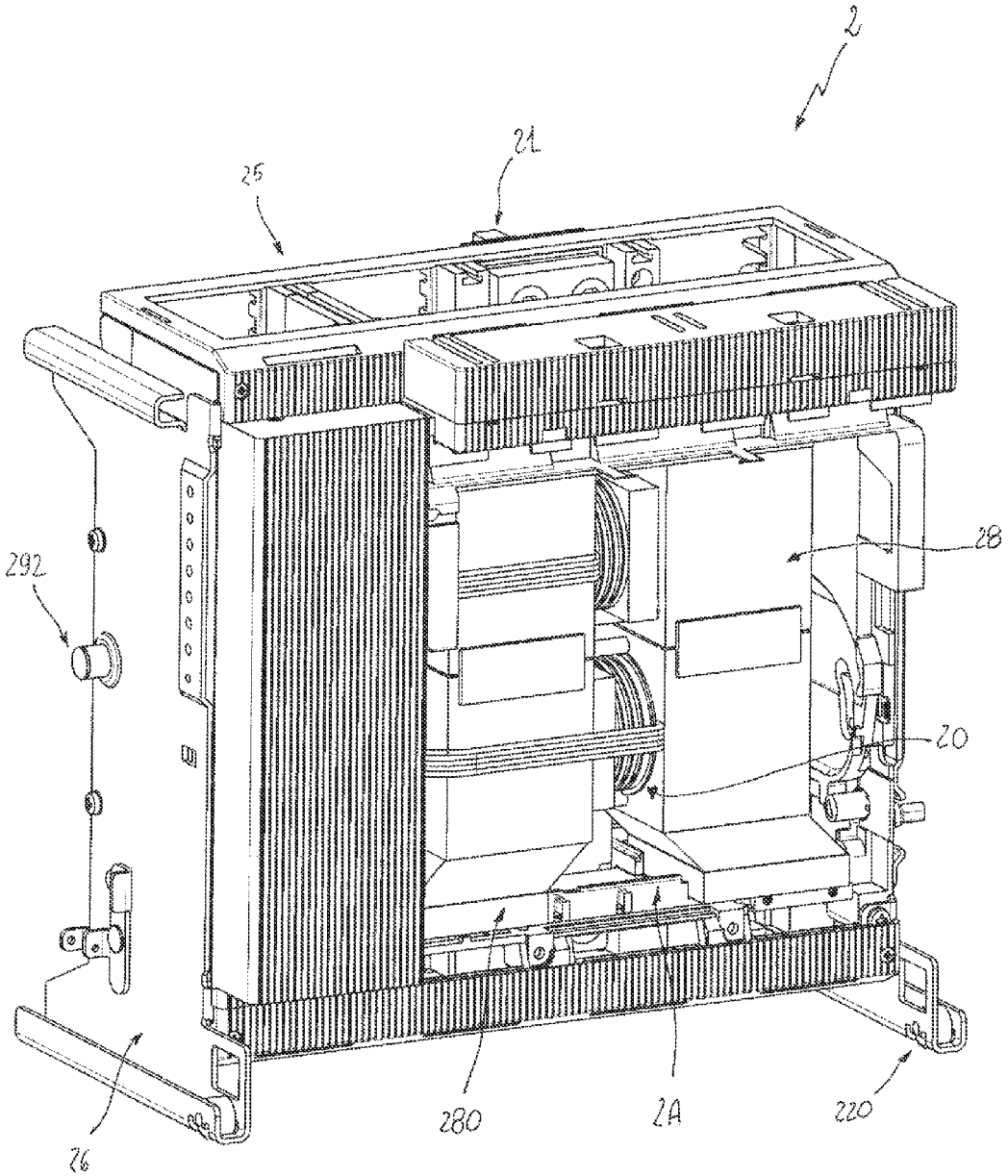
Figure 5:
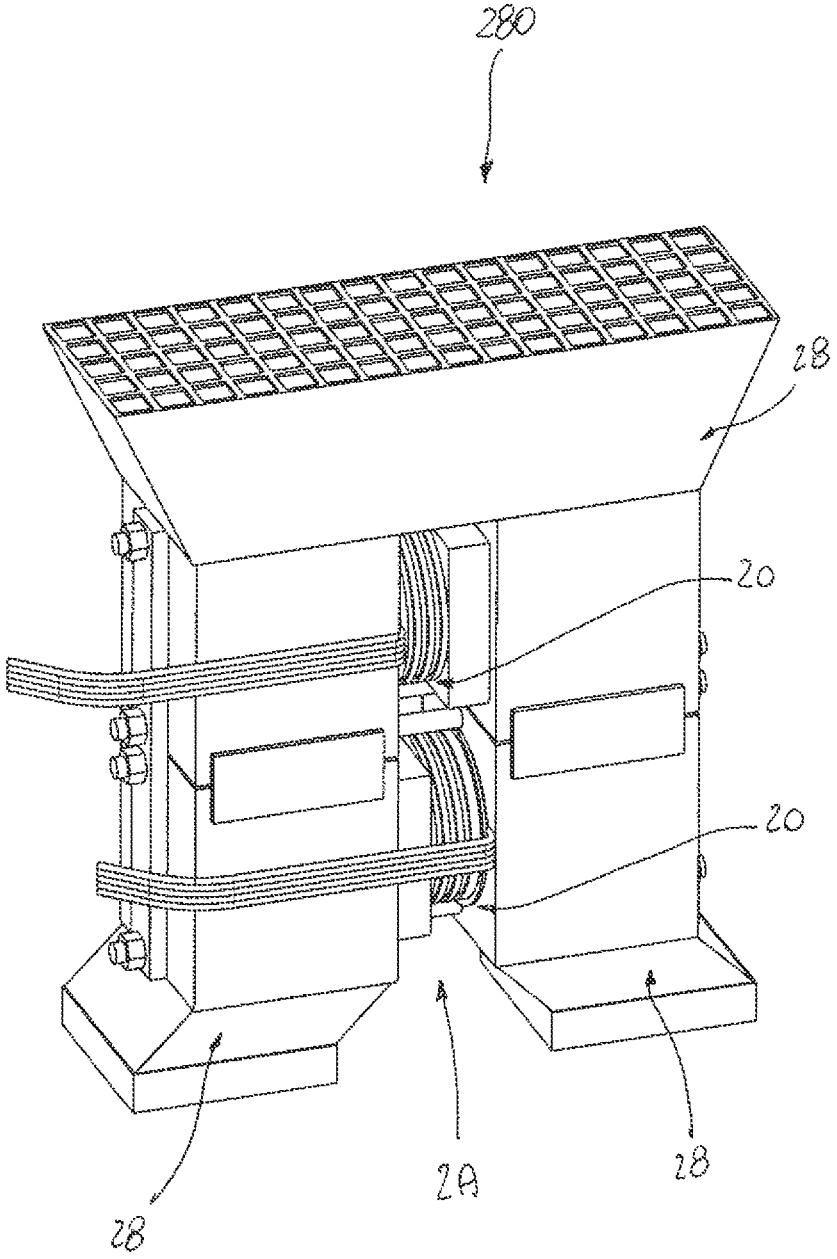
Figure 6:
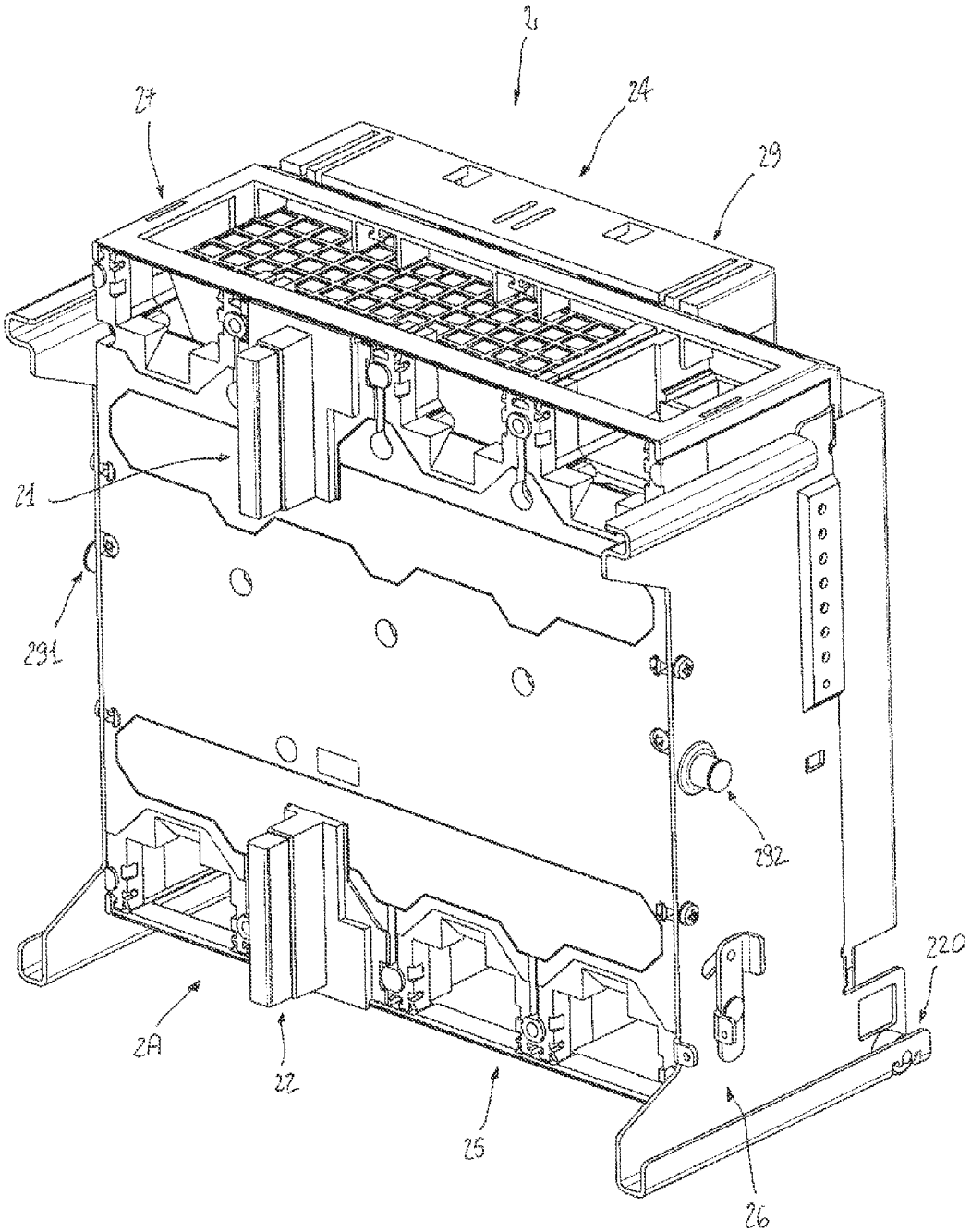
Figure 6A:
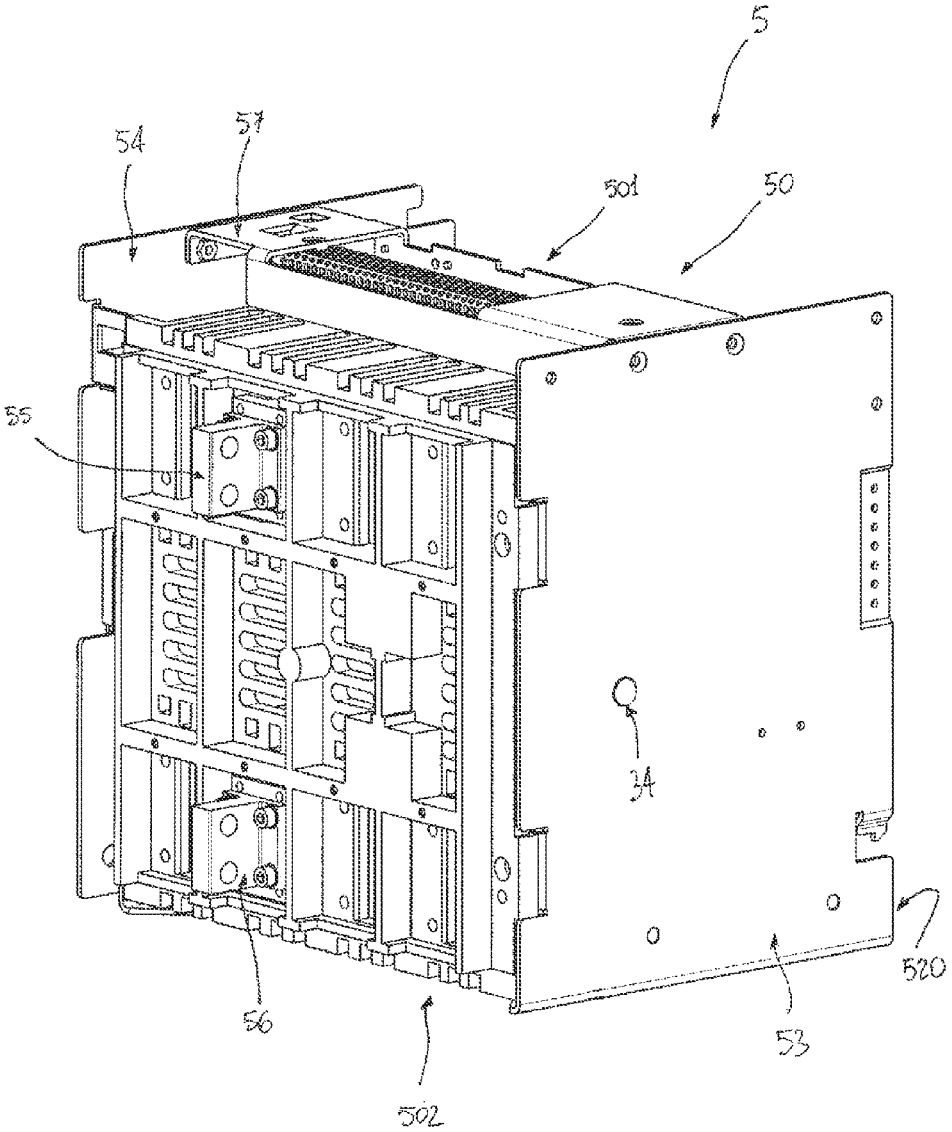
Figure 7:
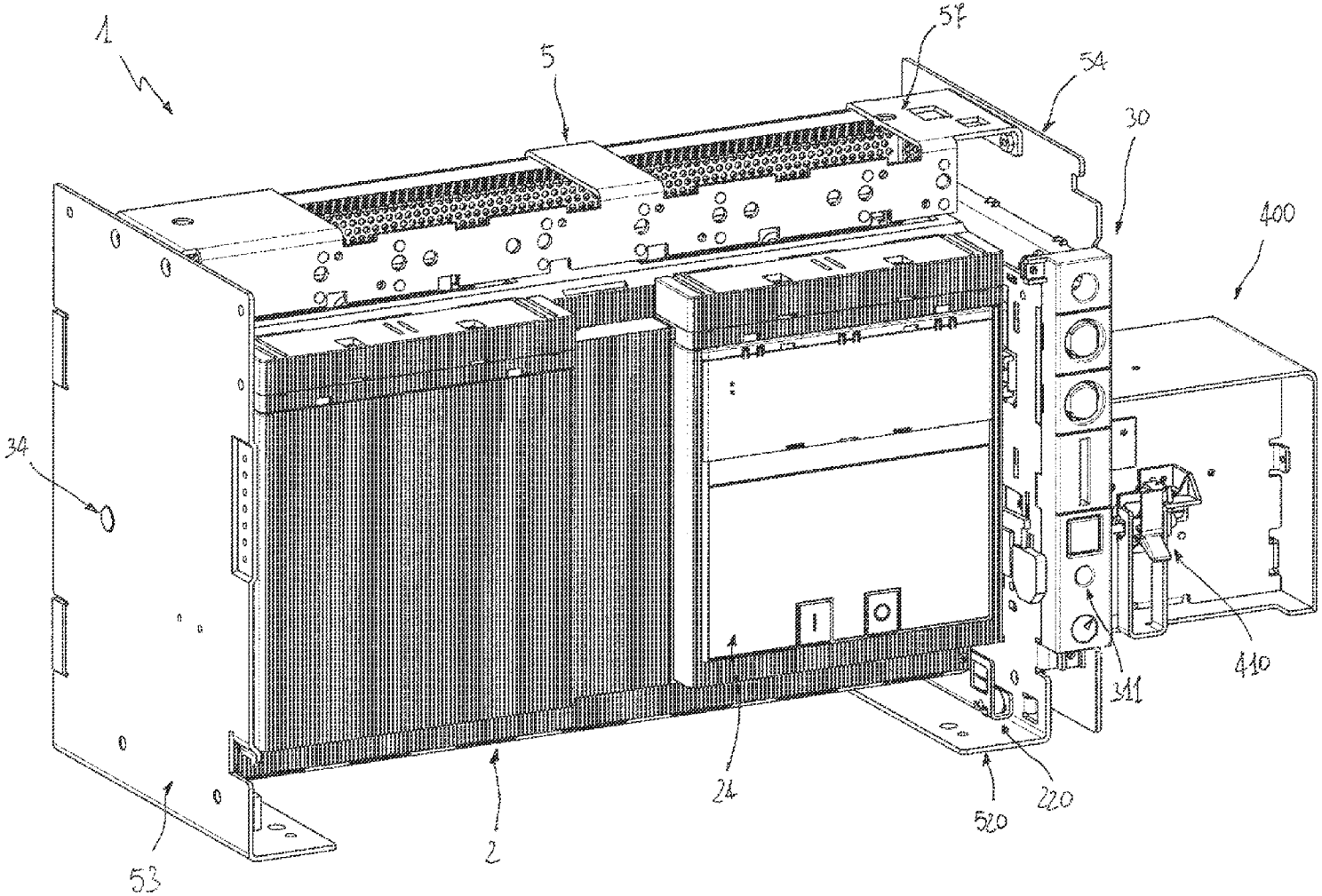
FIGS. 7-10 schematically show different views of a further embodiment of a switching device, according to the invention.
Figure 8:
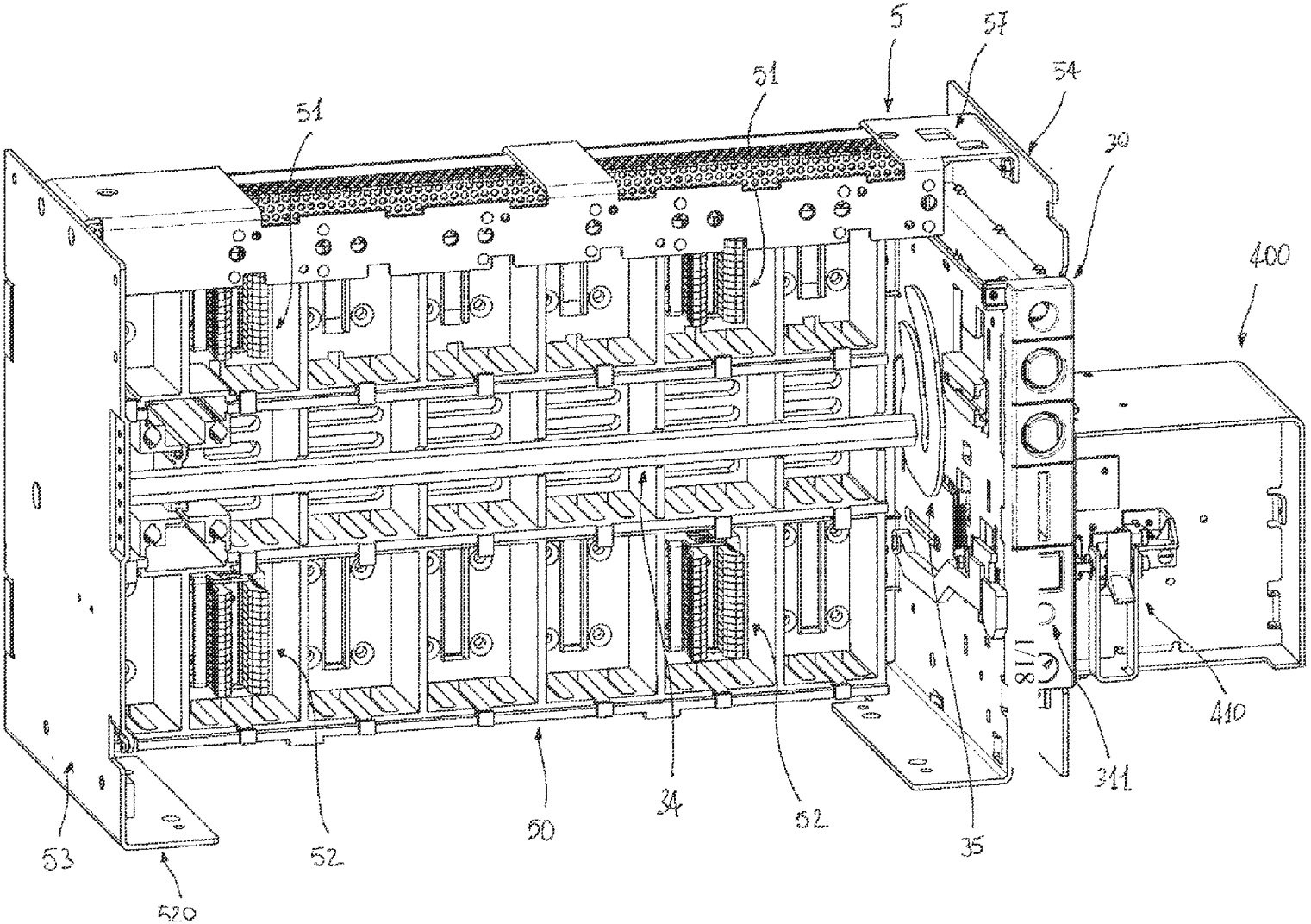
Figure 9:
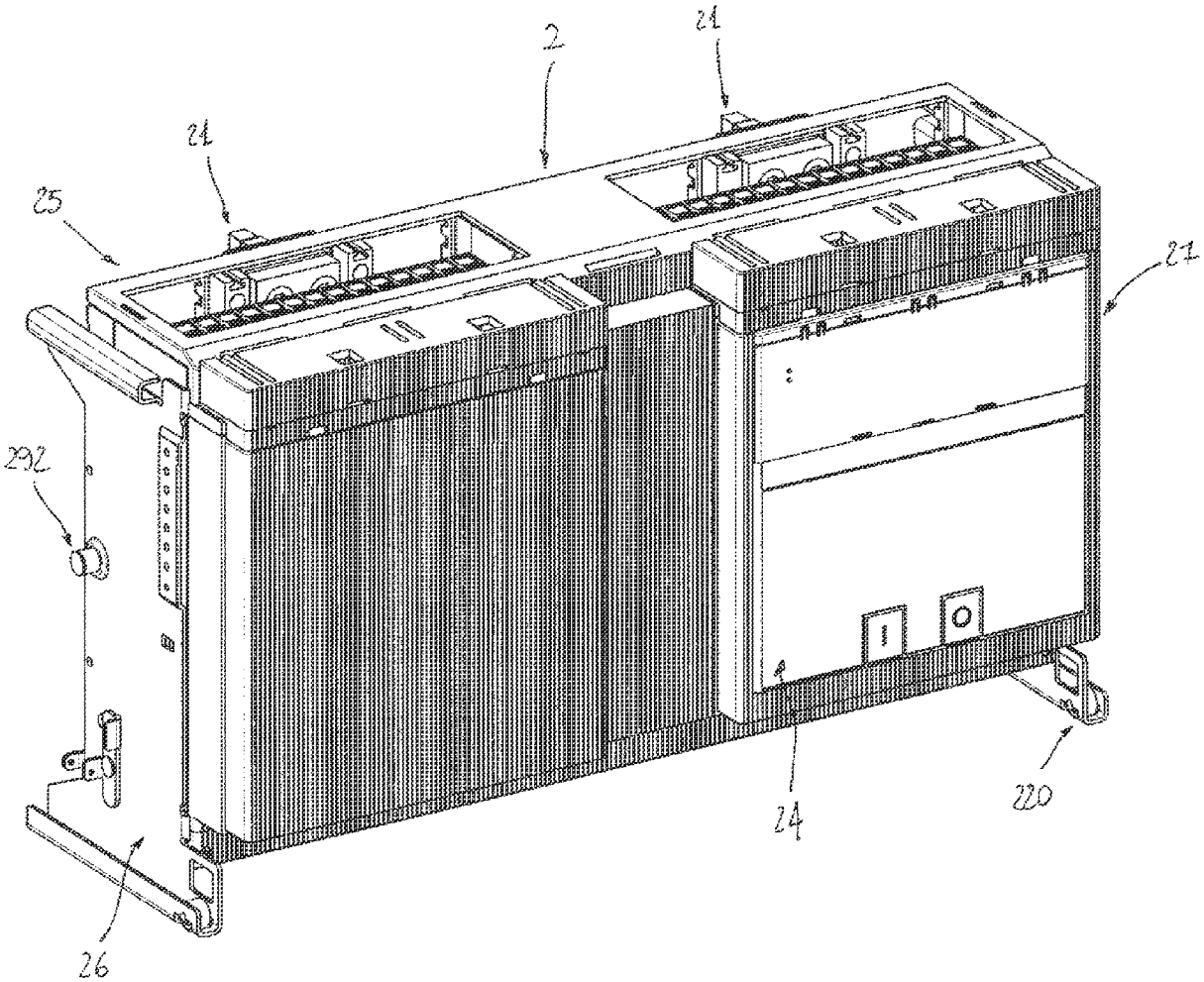
Figure 10:
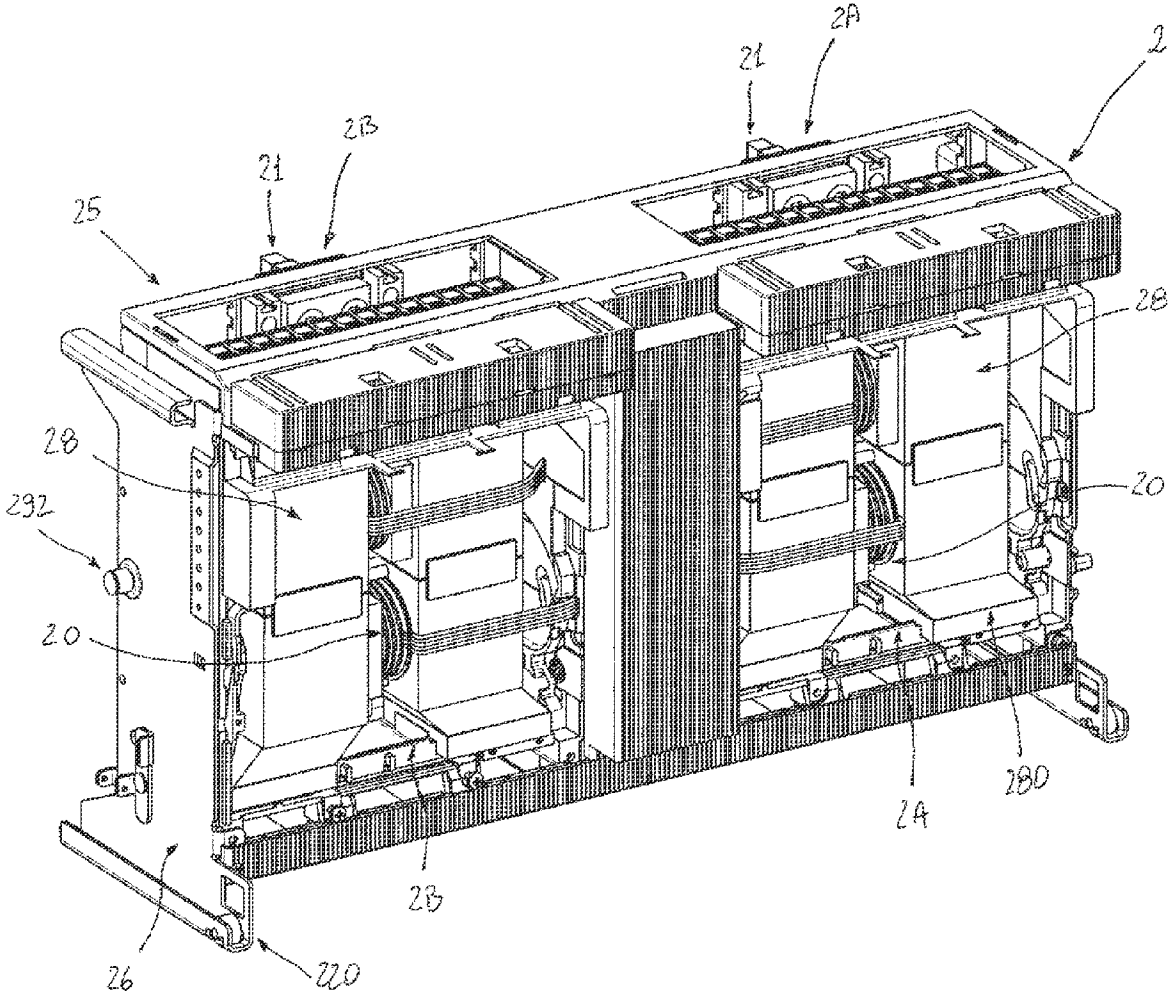
Figure 11:
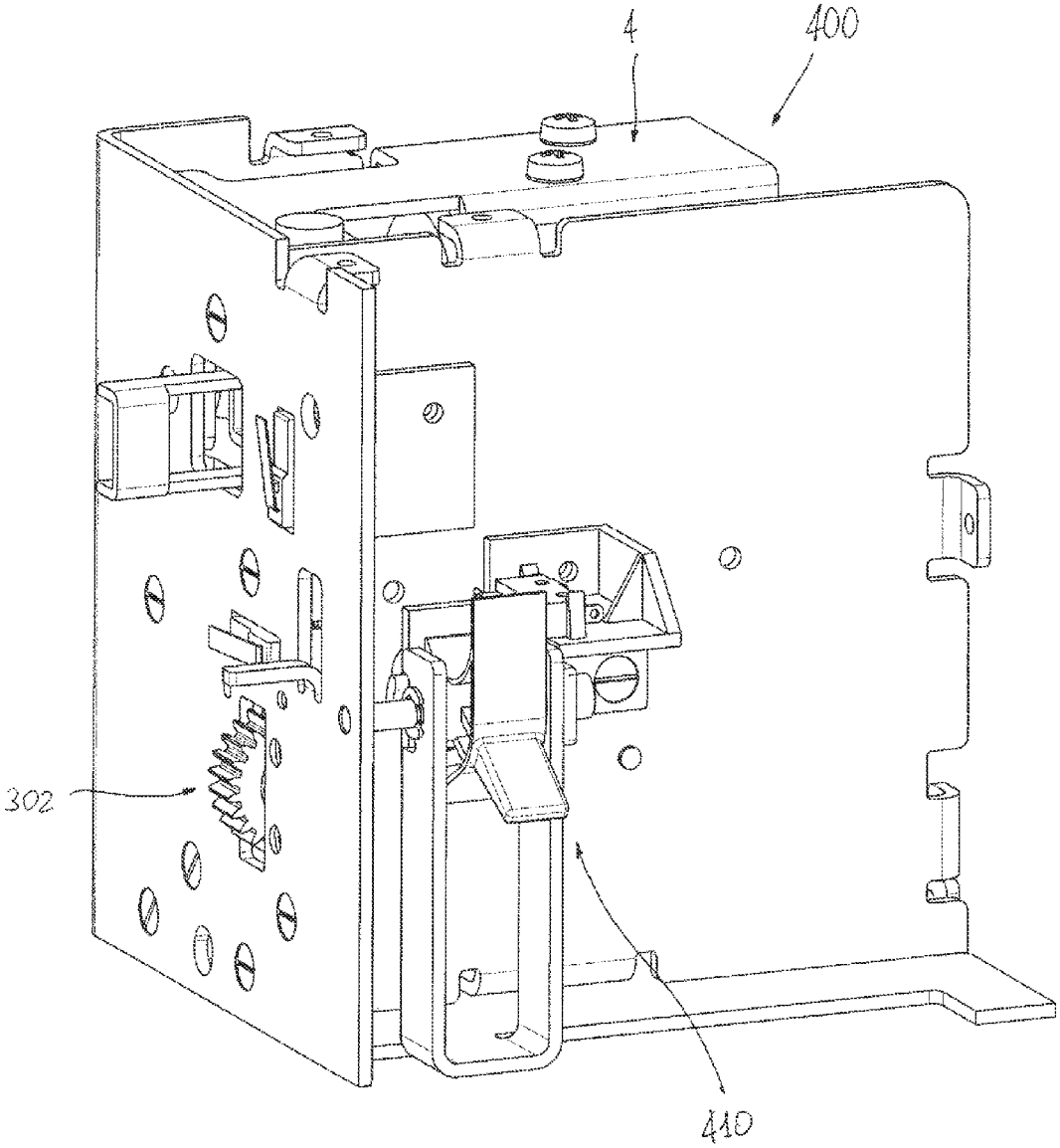
FIGS. 11-15 schematically show different views of a possible embodiment of actuating means of the switching device, according to the invention.
Figure 12:
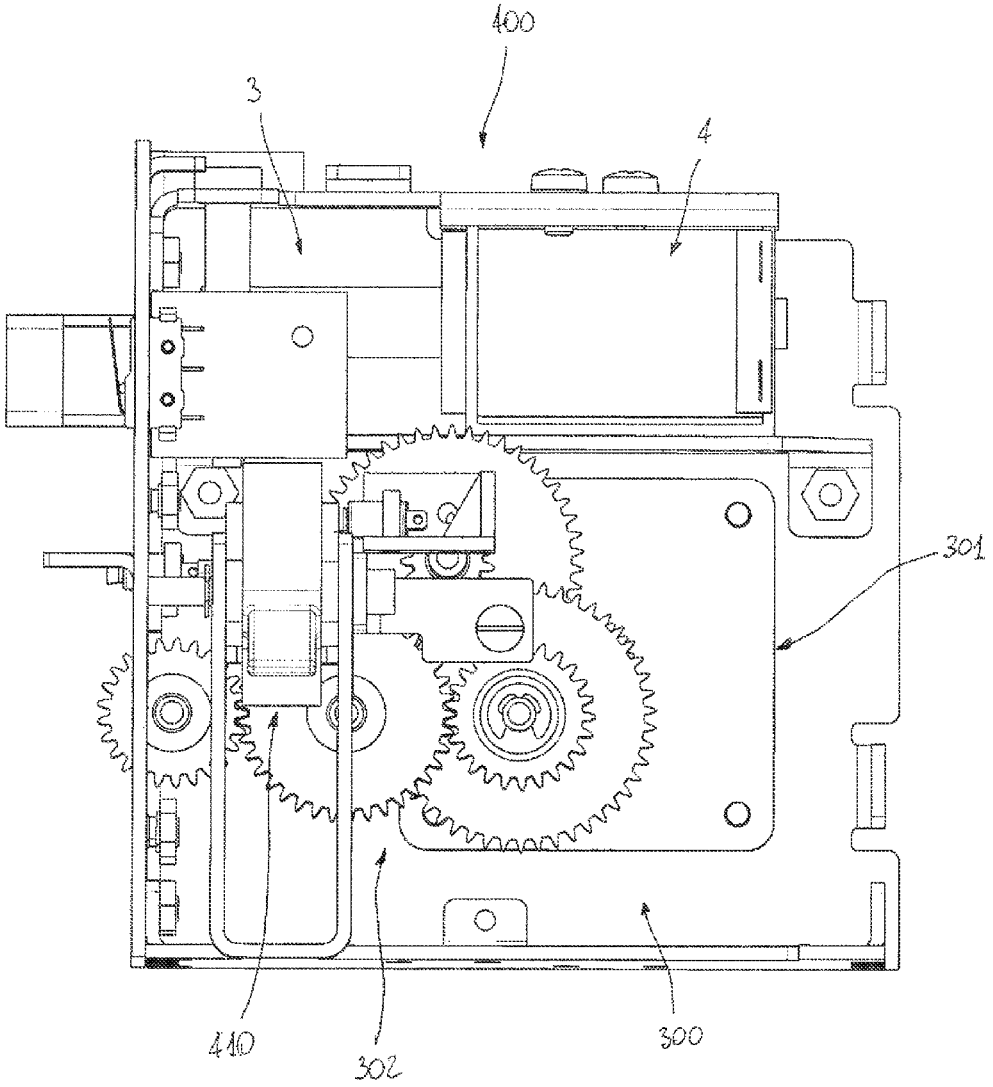
Figure 13:
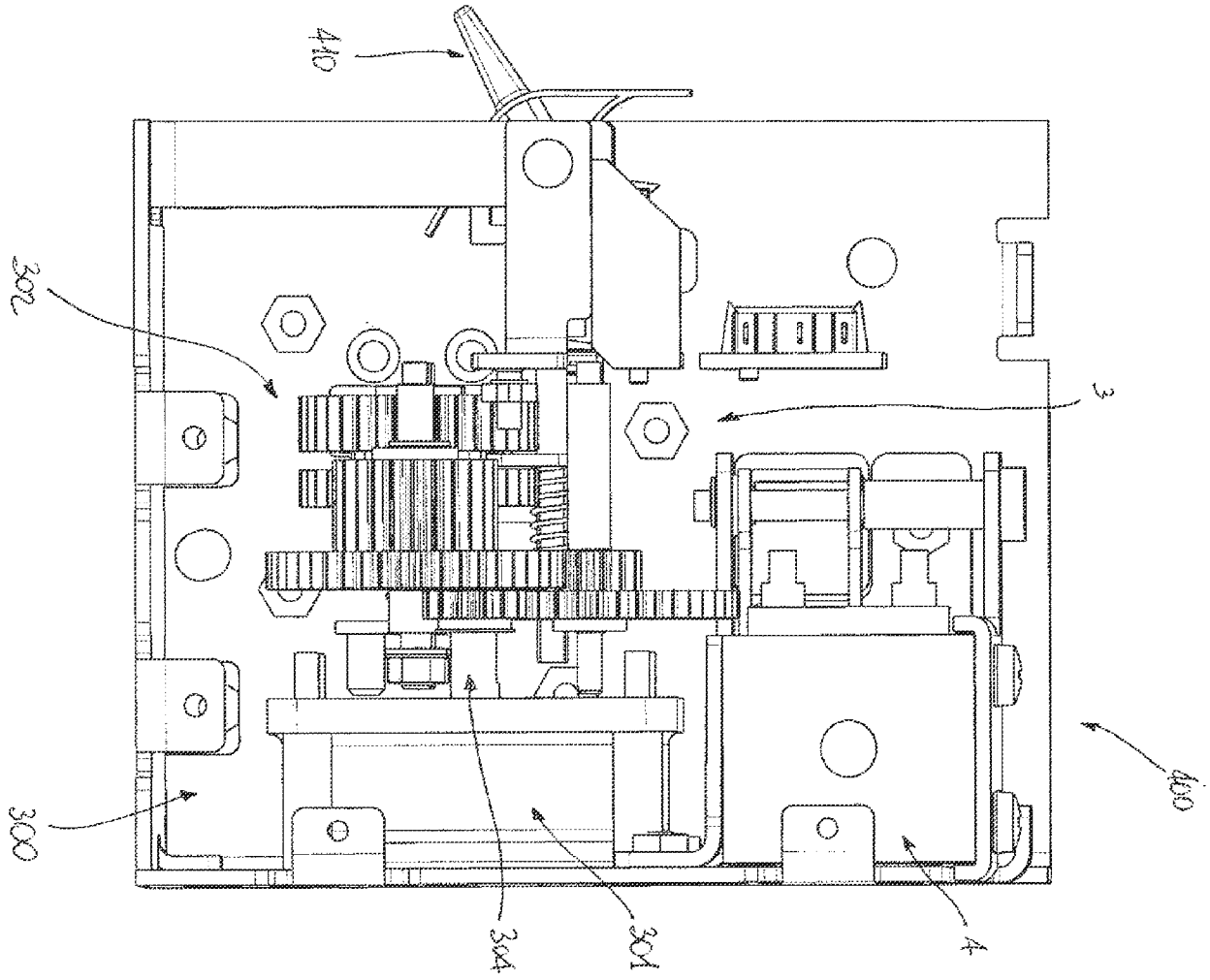
Figure 14:
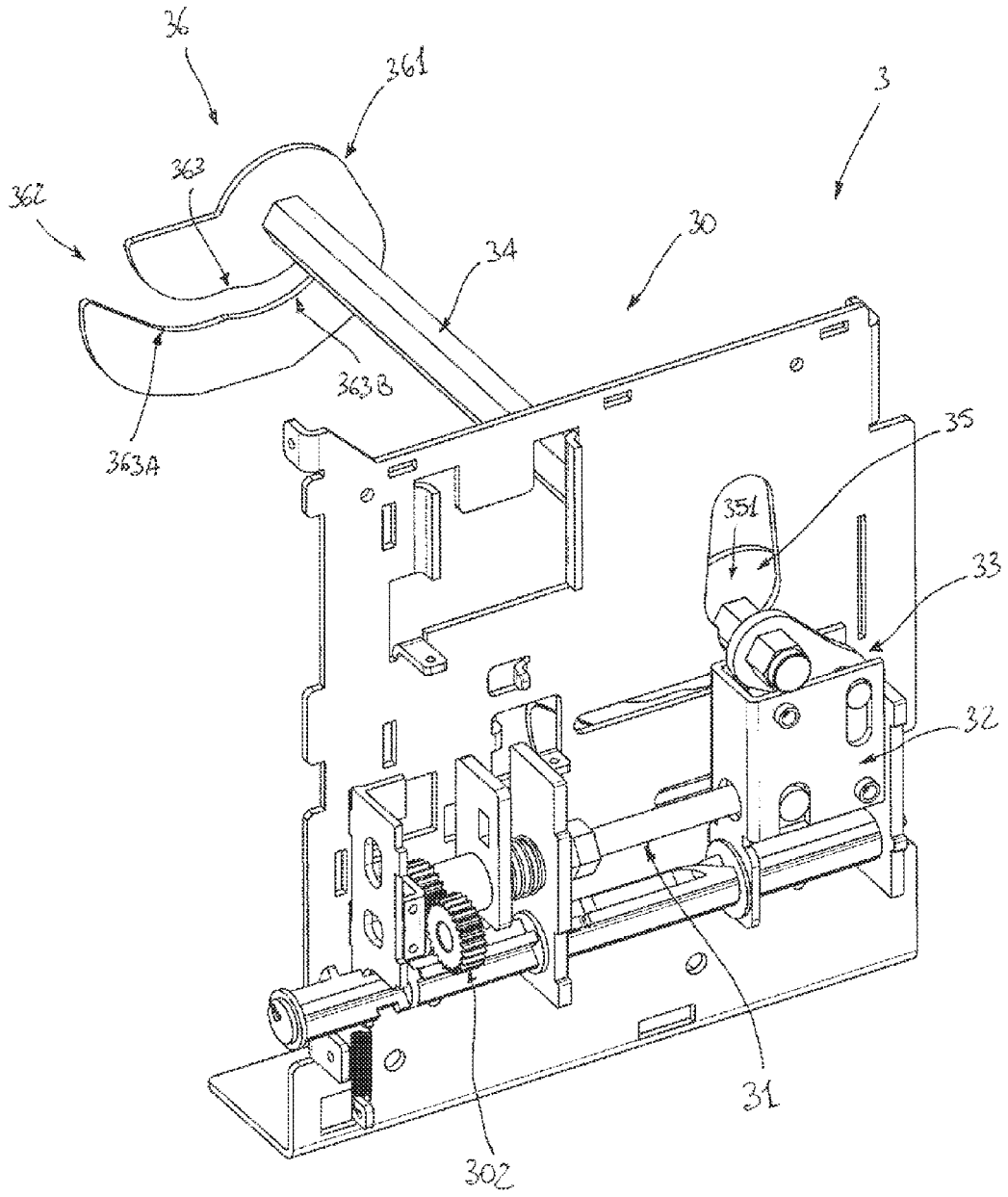
Figure 15:
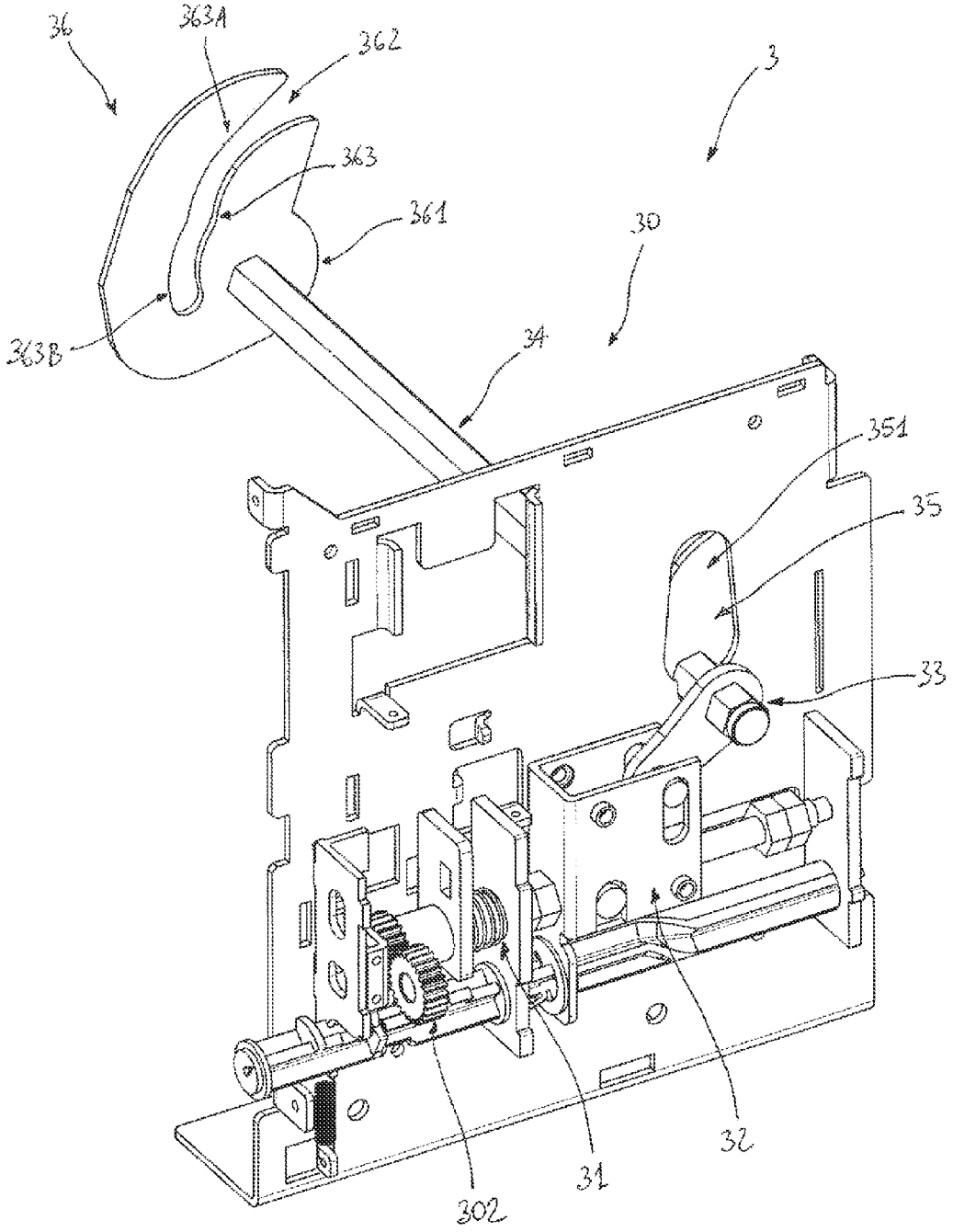

As shown in the cited figures, the control unit 4 may be arranged in a command module 400 positioned at one of the side walls 53, 54 of the supporting frame 5 (see FIG. 2).

The command module 400 may advantageously include also the motor means 300 for space saving purposes.

As an alternative, the control unit 4 may be positioned on board the switching unit 2 or in a remote position with respect to this latter.

Preferably, the control unit 4 is fed by an auxiliary power supply (not shown). Advantageously, the control unit 4 may comprise storing means (such as one or more capacitors) to store an amount of electric energy in order to ensure the execution of certain functionalities, in case the auxiliary power supply is interrupted for some reasons.

The control unit 4 preferably comprises a user interface 410, for example a command push-button, by means of which a user can send command signals for performing an insertion/withdrawn operation of the switching unit 2.

The control unit 4 comprises control means 41 for coordinating the operation of the actuating means 3 and the solid state switches 20, when an insertion/withdrawn operation of the switching unit 2 has to be performed.

A withdrawn operation may, for example, be aimed at achieving a galvanic insulation of the switching unit 2 from external devices or power buses, so as to provide protection functionalities and/or other network management functionalities or to perform maintenance operations on the switching device 1.

An insertion operation may, for example, be aimed at re-establishing an electrical connection of the switching unit 2 with external devices or power buses, so as to provide protection functionalities and/or other network management functionalities or after the execution of maintenance operations on the switching device 1.

According to the invention, the control means 41 coordinate the operation of the actuating means 3 and the solid state switches 20, so that the actuating means 3 move the switching unit 2 between the insertion and withdrawn positions A, B, and viceversa, only when the solid state switches 20 are in an off-state.

In this manner, an insertion/withdrawn operation of the switching unit 2 always occurs in safe operating conditions, with a remarkable reduction of striking phenomena, such as electric arcs, at the mutually coupling/separating contacts 21, 22, 51, 52.

In fact, since an insertion/withdrawn operation of the switching unit 2 occurs when the solid state switches 20 are in an off-state, only small currents of few tens of mA (the leakage currents of the solid state switches 20 circulating along the electric poles) are to be interrupted, in a worst case.

The overall energy of possible arising electric arcs is thus remarkably reduced when the disconnection contacts 21, 22 of the switching unit 2 are coupled/separated with/from the corresponding disconnection contacts 51, 52 of the supporting frame 5, thereby avoiding destructive effects.

Preferably, the control unit 4 comprises a digital processing device (not shown), such as a microcontroller.

Preferably, the control means 41 are computerized means, i.e. a set of software instructions, modules or routines that can be executed by said digital processing device.

As an alternative, the control unit 4 may be of the analog type and the control means 41 may comprise one or more suitable analog circuits.

Of course, other solutions are possible, according to the needs.

Preferably, the control means 41 are configured to receive first command signals S1 to perform an insertion/withdrawn operation of the switching unit 2.

The control means 41 are configured to immediately provide second command signals S2 to commutate the solid state switches 20 of each electric pole in an off-state, upon the reception of the control signals S1.

Preferably, the control means 41 are configured to receive enabling signals E from a suitable first sensor 202, said signals E being indicative of the operative state of the solid state switches 20.

According to some embodiments of the present invention, when the solid state switches 20 are commutated in an off-state (the control unit has received an enabling signal E), the control means 41 provide third command signals S3 to enable the actuating means 3 to move the switching unit 2.

In case of a motorised manoeuvre of the switching unit 2, the control means 41 preferably provide fourth command signals S4 to activate the motor means 300 for moving the switching unit 2.

The command signals S2 may be current or voltage signals that are suitable for driving the solid state switches 20 and commutate these latter in an off-state.

The command signals S1, S3, S4 may be of different types, depending on the solution adopted for executing the insertion/withdrawn operation of the switching unit 2.

According to some embodiments of the invention, in which the mechanical energy for executing an insertion or withdrawn operation of the switching unit 2 may be provided by the motor means 300, the command signals S1 may be sent by the command push-button 410 that is operated by a user or by a remote electronic device 420 (for example a protection management unit) that is capable of communicating with the control unit 4.

Upon the reception of the command signals S1, the control unit 4 sends the command signals S2 to the solid state switches 20 in order to commutate these latter in an off-state.

When it receives the enabling signals E, the control unit 4 provides the command signals S4 for activating the motor means 300.

According to some embodiments of the invention, in which the mechanical energy for executing an insertion/withdrawn operation of the switching unit 2 may be manually provided, the command signals Si is sent by a second sensor 430 that is arranged to detect the insertion of a crank in the manoeuvring seat 311. Upon the reception of the command signals S1, the control unit 4 sends the command signals S2 to the solid state switches 20 in order to commutate these latter in an off-state.

Alternatively, the control means 41 may be configured to receive no enabling signals E and to provide no command signals S3.

In this case, the operation of the actuating means 3 and the solid state switches 20 are coordinated by advantageously exploiting the very shorter intervention time of the control unit 4, which is capable of turning the solid state switches 20 into an off-state before the switching unit 2 starts moving.

According to other embodiments of the present invention, the operation of the actuating means 3 by a crank is normally prevented by a second blocking mechanism (not shown). In this case, the control unit 4 advantageously receives an enabling signal E from the sensor 202 and provides command signals S3 to disable said second blocking mechanism. A user can then operate the actuating means 3 by the crank inserted in the manoeuvring seat 311.

According to some embodiments of the present invention, the mechanical energy for performing the withdrawn operation of the switching unit 2 may be provided by suitable actuation springs that are maintained in a compression state by a first blocking mechanism. In this case, the command signals S1 (for executing the withdrawn operation) may be sent by the command push-button 410 or by a remote electronic device 420.

Upon the reception of the command signals S1, the control unit 4 sends the command signals S2 to the solid state switches 20 in order to commutate these latter in an off-state.

When it receives an enabling signal E, the control unit 4 provides the command signals S3 for disabling said first blocking mechanism.

According to some embodiments of the invention, the command signals S1 may be sent by a third sensor 440 that detects the interruption of the auxiliary power supply of the electric motor 301 and/or the control unit 4.

Upon the reception of the command signals S1, the control unit 4 sends the command signals S2 to the solid state switches 20 in order to commutate these latter in an off-state.

For this functionality, the control unit 4 is advantageously fed by the suitably arranged storing means described above.

Now, the switching unit 2 can be safely brought in a withdrawn position by manually operating the actuation means 3.

If the electric energy stored by the storing means is enough, the control unit 4 may also provide the command signals S4 to activate the motor means 300 for an emergency withdrawing operation of the switching unit 2.

For this functionality, both the control unit 4 and the electric motor 301 are advantageously fed by the suitably arranged storing means described above.

The switching device 1 may be subject to possible variants from those described above. For example, the control means 41 may be configured to coordinate the operation of the actuating means 3 and the solid state switches 20 according to coordination schemes different from those above illustrated but all implementing the insertion/withdrawn operation of the switching unit 2 after the solid state switches 20 are commutated in an off-state.

The switching device 1 ensures a relatively high level of reliability since solid state switches 20 are adopted for interrupting the phase currents circulating along the electric poles.

Further, thanks to the adoption of the solid state switches 20, breaking operations may be performed with a relatively short interruption time. On the other hand, solid state switches 20 ensure a relatively long operating life, with the possibility of performing a high number of breaking operations.

The switching device 1 provides the integration of breaking and disconnection functionalities by adopting a single switching unit 2, in other words without the need of adopting a switching unit dedicated to perform breaking operations and a further switching unit dedicated to perform disconnection operations, as it occurs in the solutions of the state of the art.

In fact, the galvanic connection/insulation of the electric poles with/from external devices or power buses is ensured by an insertion/withdrawn operation of the switching unit 2, without the adoption of dedicated electromechanical switching devices.

Such a capability of performing integrated breaking and disconnection functionalities provides remarkable advantages as regard to the coordination of the breaking/disconnection operations and the interfacing between the components of the switching device.

Further, it allows obtaining a switching device that is characterised by a simplified structure, with a relatively small size.

The switching device 1 provides improvements over the execution of disconnection operations.

When a disconnection operation is performed, the solid state switches 20 of each electric pole are electrically insulated from external devices or power buses at two disconnection points, upstream and downstream their operative position.

This feature provides an improved insulation from power buses or devices positioned upstream with respect to the switching device 1 and electric loads positioned downstream. Further, this feature allows more easily and safely interventions on the solid state switches 20, e.g. for maintenance purposes.

In addition, it simplifies the execution of retrofitting interventions on the field, e.g. the replacement of a switching device, which is already installed on the field and which comprises separate breaking and disconnection units, with a new switching device, which has a single switching unit and is however capable of providing integrated breaking and disconnection functionalities.

The switching device 1 has proven to be of relatively easy and low-cost realization at industrial level and practical installation on the field.

The switching device thus conceived is susceptible of modifications and variations, all of which are within the scope of the inventive concept as defined in particular by the appended claims; any possible combination of the previously disclosed embodiments can be implemented and has to be considered within the inventive concept of the present disclosure; all the details may furthermore be replaced with technically equivalent elements.

Also the materials used, so long as they are compatible with the specific use and purpose, as well as the dimensions, may be any according to the requirements and the state of the art.

The invention claimed is:

1. A switching device which comprises:

a switching unit comprising an external case that houses one or more electric poles, said switching unit comprising, for each of said electric poles, a first disconnection contact, a second disconnection contact and one or more solid state switches, which can be switched between an on-state and an off-state, and vice versa;

a supporting frame comprising, for each of said electric poles, a third disconnection contact and a fourth disconnection contact, wherein said switching unit is movable, with respect to said supporting frame, between an insertion position (A) where said first disconnection contact and said second disconnection contact are coupled with the corresponding third disconnection contact and fourth disconnection contact, respectively, and a withdrawn position (B) where said first disconnection contact and said second disconnection contact are separated from the corresponding third disconnection contact and fourth disconnection contact, respectively, and vice versa;

actuating means for moving said switching unit between said insertion position (A) and said withdrawn position (B), and vice versa;

a control unit, which is configured to control the operation of said switching unit and said actuating means, said control unit comprising control means that are configured to coordinate the operation of said actuating means and said solid state switches, when an insertion/withdrawn operation of said switching unit has to be performed, so that said actuating means move said switching unit only when said solid state switches are in an off-state.

2. A switching device, according to claim 1, wherein said control means are configured to receive a first command signal (S1) to perform an insertion/withdrawn operation of said switching unit, said control means providing a second command signal to commutate said solid state switches in an off-state, upon the reception of said first command signal.

3. A switching device, according to claim 2, wherein said control means are configured to provide a third command signal (S3) to enable said actuating means to move said switching unit, when said solid state switches are commutated in an off-state.

4. A switching device, according to claim 2, wherein said control means are configured to provide a fourth command signal (S4) to activate motor means for moving said switching unit, when said solid state switches are commutated in an off-state.

5. A switching device, according claim 1, wherein said first and second disconnection contacts are arranged on a back wall of said switching unit and said third and fourth disconnection contacts are arranged on a supporting wall of said supporting frame, said supporting wall being operatively associated with said back wall, when said switching unit is in said insertion position (A).

6. A switching device, according to claim 1, wherein said actuating means comprise motor means for providing the mechanical energy for moving said switching unit.

7. A switching device, according to claim 1, wherein said actuating means can be manually operated by an actuation tool for providing the mechanical energy for moving said switching unit.

8. A switching device, according to claim 1, wherein said actuating means comprise mechanical transmission means that are configured to transmit the mechanical energy for moving said switching unit.

9. A switching device, according to claim 8, wherein said mechanical transmission means comprise a first kinematic chain, which is configured to transform the motion imparted by a motor means or by an actuation tool in a translatory motion of a movable carriage, and a second kinematic chain, which is configured to transform the translatory motion of said movable carriage in a rotary motion of a transmission shaft that is solidly connected with a first clamping element and second clamping element that can be operatively coupled respectively to a first clamping pin and a second clamping pin of the external case of said switching unit.

10. A switching device, according to claim 9, said first clamping element and said second clamping element are formed respectively by a first plate and a second plate, which are shaped so as to define a first clamping seat and a second clamping seat that are operatively coupled to said first clamping pin and said second clamping pin, respectively at first coupling edges and second coupling edges, which are shaped so as to have an eccentric profile with respect to the rotation axis of said transmission shaft.

11. A switching device, according to claim 10, wherein said first and second coupling edges have first portions and second portions, which are shaped so as to have different eccentric profiles with respect to the rotation axis of said transmission shaft.

12. A switching device, according to claim 9, wherein said first clamping pin and said second clamping pin are arranged on opposite lateral walls of said switching unit.

13. A switching device, according to claim 3, wherein said control means are configured to provide a fourth command signal (S4) to activate motor means for moving said switching unit, when said solid state switches are commutated in an off-state.

14. A switching device, according to claim 2, wherein said first and second disconnection contacts are arranged on a back wall of said switching unit and said third and fourth disconnection contacts are arranged on a supporting wall of said supporting frame, said supporting wall being operatively associated with said back wall, when said switching unit is in said insertion position (A).

15. A switching device, according to claim 3, wherein said first and second disconnection contacts are arranged on a back wall of said switching unit and said third and fourth disconnection contacts are arranged on a supporting wall of said supporting frame, said supporting wall being operatively associated with said back wall, when said switching unit is in said insertion position (A).

16. A switching device, according to claim 4, wherein said first and second disconnection contacts are arranged on a back wall of said switching unit and said third and fourth disconnection contacts are arranged on a supporting wall of said supporting frame, said supporting wall being operatively associated with said back wall, when said switching unit is in said insertion position (A).

17. A switching device, according to claim 2, wherein said actuating means comprise motor means for providing the mechanical energy for moving said switching unit.

18. A switching device, according to claim 3, wherein said actuating means comprise motor means for providing the mechanical energy for moving said switching unit.

19. A switching device, according to claim 4, wherein said motor means provide the mechanical energy for moving said switching unit.

20. A switching device, according to claim 5, wherein said actuating means comprise motor means for providing the mechanical energy for moving said switching unit.

* * * * *